US008635739B2

(12) United States Patent
Lee et al.

(10) Patent No.: US 8,635,739 B2
(45) Date of Patent: Jan. 28, 2014

(54) ROBOT CLEANER SYSTEM HAVING ROBOT CLEANER AND DOCKING STATION

(75) Inventors: Youn Baek Lee, Suwon-si (KR); Soo Sang Yang, Suwon-si (KR); Yeon Taek Oh, Yongin-si (KR); Jeong Hun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 301 days.

(21) Appl. No.: 13/247,430

(22) Filed: Sep. 28, 2011

(65) Prior Publication Data

US 2012/0060320 A1 Mar. 15, 2012

Related U.S. Application Data

(62) Division of application No. 12/149,375, filed on Apr. 30, 2008.

(30) Foreign Application Priority Data

Aug. 24, 2007 (KR) ..... 10-2007-0085304

(51) Int. Cl.
*A47L 9/10* (2006.01)

(52) U.S. Cl.
USPC ..... 15/319; 15/352

(58) Field of Classification Search
USPC ..... 15/319, 339, 352; 700/245
IPC ..... A47L 9/10
See application file for complete search history.

(56) References Cited

U.S. PATENT DOCUMENTS

| | | | | |
|---|---|---|---|---|
| 6,896,468 | B2 | 5/2005 | Gallea et al. | |
| 7,779,504 | B2 * | 8/2010 | Lee et al. | 15/319 |
| 2002/0124343 | A1 | 9/2002 | Reed | |
| 2005/0150519 | A1 | 7/2005 | Keppler et al. | |

FOREIGN PATENT DOCUMENTS

KR 10-2007-0010298 1/2007

OTHER PUBLICATIONS

U.S. Office Action mailed Jan. 12, 2012 issued in co-pending U.S. Appl. No. 12/149,375.
U.S. Office Action mailed Jun. 13, 2013 issued in co-pending U.S. Appl. No. 12/149,375.
Mar. 17, 2011 Office Action (Restriction Requirement) in co-pending U.S. Appl. No. 12/149,375.
Jun. 21, 2011 Office Action in co-pending U.S. Appl. No. 12/149,375.
U.S. Appl. No. 12/149,375, filed Apr. 30, 2008, Youn Baek Lee, Samsung Electronics Co., Ltd.

* cited by examiner

*Primary Examiner* — David Redding
(74) *Attorney, Agent, or Firm* — Staas & Halsey LLP

(57) ABSTRACT

A robot cleaner system includes docking structure to allow a dust discharge port of a robot cleaner to come into close contact with a dust suction port of a docking station without an additional drive device. The robot cleaner system includes a robot cleaner having a dust discharge port, a docking station having a dust suction port to suction dust collected in the robot cleaner, and a docking device to perform a seesaw movement as it contacts the robot cleaner when the robot cleaner docks with the docking station, to allow the dust suction port to come into close contact with the dust discharge port. The docking device includes a link member installed in the docking station in a pivotally rotatable manner, one end having a contact portion to come into contact with the robot cleaner, and the other end having a docking portion defining the dust suction port therein.

4 Claims, 7 Drawing Sheets

ROBOT CLEANER SYSTEM HAVING ROBOT CLEANER AND DOCKING STATION

CROSS-REFERENCE TO RELATED APPLICATION

This application is a Divisional application of application Ser. No. 12/149,375 filed Apr. 30, 2008, now pending, and is based upon and claims the benefit of priority from the prior Korean Patent Application No. 2007-0085304, filed on Aug. 24, 2007, the entire contents of both of which are incorporated herein by reference.

BACKGROUND OF THE INVENTION

1. Field of the Invention

The present invention relates to a robot cleaner system, and, more particularly, to a robot cleaner system having a docking station installed to suction and remove dust collected in a robot cleaner.

2. Description of the Related Art

A cleaner is an appliance to get rid of dirt and clean a room. Generally used is a vacuum cleaner to suction dirt by use of a suction force generated from a low-pressure unit. Recently, the development of a robot cleaner is underway. The robot cleaner get rids of dirt from the floor by a self-running function thereof without a user's labor.

Generally, the robot cleaner is used together with a station (hereinafter, referred to as a "docking station"), to constitute a single system. The docking station is located at a desired position of a room and has the function of charging the robot cleaner or removing dust collected in the robot cleaner.

An example of the robot cleaner system is disclosed in U.S. Published Patent No. 2005/0150519. The disclosed robot cleaner system includes a robot cleaner, and a docking station having a dust suction unit. The robot cleaner has a dust suction port perforated in the bottom thereof, and a brush is rotatably installed to the suction hole to sweep away dust on the floor. The docking station has a deck formed with a slope to allow the robot cleaner to ascend thereon, and a dust suction port is formed in a position of the slope. With this configuration, if the robot cleaner ascends along the slope and reaches a docking position, the suction hole of the robot cleaner and the suction hole of the slope are aligned to face each other. In this state, dust collected in the robot cleaner can be got rid of by operation of the suction unit.

In the above described conventional robot cleaner system, the suction of dust from the robot cleaner into the docking station is carried out, in a state wherein both the suction holes of the robot cleaner and the docking station simply face each other, without a docking device to connect the robot cleaner and the docking station to each other. This, however, has a problem of the great loss of a suction force generated from the suction unit or causing the dust being moved from the robot cleaner into the docking station to be leaked again into a room.

As a solution of the above described problems, Korean Patent Laid-open Publication No. 2007-0010298 discloses a dust-removal device (docking station) for a robot cleaner, which has a connector to be moved up and down by operation of a drive device.

If the robot cleaner docks with the dust-removal device, the connector of the dust-removal device is moved down to be inserted into the robot cleaner, thereby communicating with a dust receptacle provided in the robot cleaner. In this state, dust collected in the dust receptacle of the robot cleaner can be suctioned into the dust-removal device through the connector by operation of a fan motor assembly of the dust-removal device.

In the above described dust-removal device, since the suction of dust from the robot cleaner into the dust-removal device is carried out in a state wherein the connector of the dust-removal device is inserted into the robot cleaner, the dust collected in the robot cleaner can be efficiently removed without the loss of a suction force. However, to move the connector, it is necessary to provide a drive device for the connector within the dust-removal device, and this has a problem of complicating the configuration of the dust-removal device.

SUMMARY OF THE INVENTION

Accordingly, it is an aspect of the invention to provide a robot cleaner system having an improved docking structure, in which a dust discharge port of a robot cleaner can come into close contact with a dust suction port of a docking station without an additional drive device.

Additional aspects and/or advantages of the invention will be set forth in part in the description which follows and, in part, will be obvious from the description, or may be learned by practice of the invention.

In accordance with an aspect of the invention, the above and/or other aspects can be achieved by the provision of a robot cleaner system comprising: a robot cleaner having a dust discharge port; a docking station having a dust suction port to suction dust collected in the robot cleaner; and a docking device to contact with the robot cleaner to perform a seesaw movement when the robot cleaner docks with the docking station, so as to allow the dust suction port to close contact with the dust discharge port.

The docking device may comprise a link member rotatably mounted to the docking station.

The link member may comprise one end having a contact portion to contact with the robot cleaner, and the other end having a docking portion defining the dust suction port therein.

The contact portion may be provided with a roller to rotate in contact with the robot cleaner.

The docking device may further comprise an elastic member to elastically bias the link member such that the dust suction port is spaced apart from the dust discharge port.

The docking device may comprise a flexible joint pipe having one end communicating with the dust suction port and the other end fixed to the docking station.

The docking device may comprise a sealing member to seal a gap between the dust discharge port and the dust suction port.

The robot cleaner may comprise a slope to guide the seesaw movement of the docking device when the robot cleaner moves in contact with the docking device.

The docking station may comprise a suction device to generate a suction force, and a dust-collecting device to collect dust suctioned from the robot cleaner.

The robot cleaner system may further comprise a manual vacuum cleaner to be connected with the docking station, to suction the dust collected in the robot cleaner through the dust suction port.

In accordance with another aspect of the invention, there is provided a robot cleaner system comprising: a robot cleaner having a dust discharge port; a docking station having a dust suction port to suction dust collected in the robot cleaner and a connecting port communicating with the dust suction port; a docking device to be pivotally rotated as it comes into contact with the robot cleaner when the robot cleaner docks with the docking station, so as to allow the dust suction port to close contact with the dust discharge port; and a manual vacuum cleaner having a connecting pipe to be fitted into the connecting port, the manual vacuum cleaner being used to suction the dust from the robot cleaner through the dust discharge port, the dust suction port, and the connecting pipe.

The docking device may comprise a link member rotatably mounted to the docking station, and the link member may comprise one end having a contact portion to come into contact with an upper surface the robot cleaner, and the other end having the dust suction port.

The link member may perform a seesaw movement in a first direction when the robot cleaner moves while contacting with the contact portion, so as to allow the dust suction port to come into close contact with the dust discharge port, and also may perform a seesaw movement in a second direction when the robot cleaner is separated from the contact portion, so as to space apart the dust suction port from the dust discharge port.

In accordance with a further aspect of the invention, there is provided a robot cleaner system comprising: a robot cleaner having a dust discharge port; a docking station having a dust suction port to suction dust collected in the robot cleaner; and a docking device to perform a seesaw movement as it comes into contact with the docking station when the robot cleaner docks with the docking station, so as to allow the dust discharge port to come into close contact with the dust suction port.

In accordance with another aspect of the invention, there is provided a docking station to dock with a robot cleaner having a dust discharge port, the docking station comprising: a frame; and a link member rotatably coupled to the frame, wherein the link member comprises a contact portion to be pivotally rotated as it comes into contact with the robot cleaner upon docking of the robot cleaner, and a dust suction port formed at the opposite side of the contact portion about a rotating center of the link member, the dust suction port coming into close contact with the dust discharge port of the robot cleaner by the pivotal rotation of the contact portion.

In accordance with yet another aspect of the invention, there is provided a robot cleaner to dock with a docking station having a dust suction port so as to discharge dust collected therein, the robot cleaner comprising: a frame; and a link member rotatably coupled to the frame, wherein the link member comprises a contact portion to be pivotally rotated as it comes into contact with the docking station, and a dust discharge port formed at the opposite side of the contact portion about a rotating center of the link member, the dust discharge port coming into close contact with the dust suction port of the docking station by the pivotal rotation of the contact portion.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
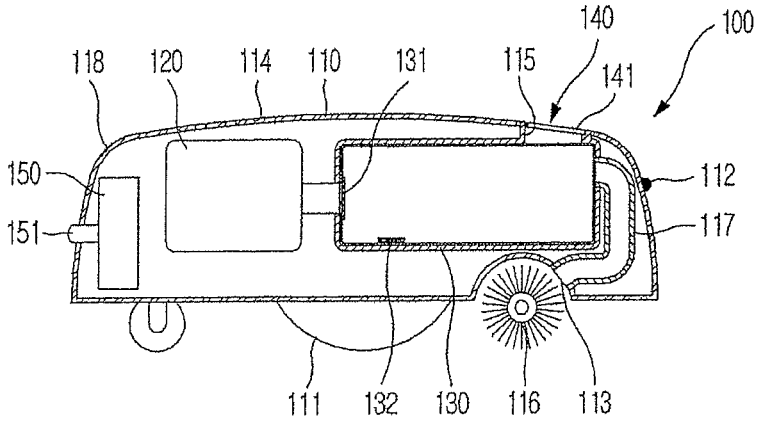
FIGS. 1 and 2 are sectional views, respectively, showing a robot cleaner and a docking station of a robot cleaner system according to a first embodiment of the present invention.

Reference will now be made in detail to preferred exemplary embodiments of the present invention, examples of which are illustrated in the accompanying drawings, wherein like reference numerals refer to like elements throughout. The embodiments are described below to explain the present invention by referring to the figures.

Figure 2:
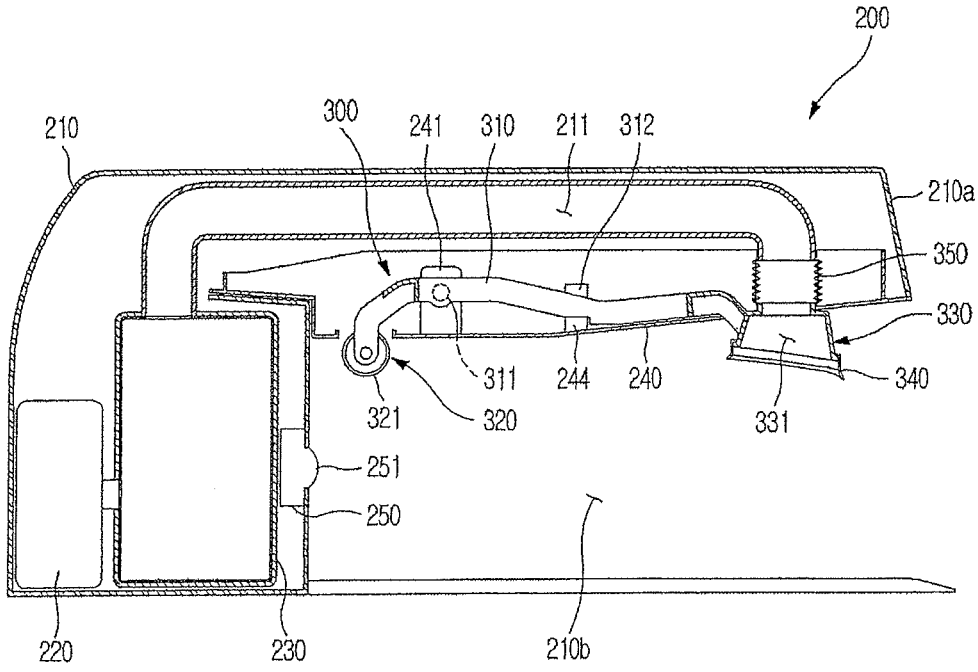

FIGS. 1 and 2 are sectional views, respectively, showing a robot cleaner and a docking station of a robot cleaner system according to a first embodiment of the present invention.

As shown in FIGS. 1 and 2, the robot cleaner system according to the present invention includes a robot cleaner 100 and a docking station 200. The robot cleaner 100 performs a cleaning operation for a cleaning region by self-running thereof, and returns to the docking station 200 if dust over a predetermined level is accumulated therein, to discharge the dust.

As shown in FIG. 1, the robot cleaner 100 includes a robot body 110, and a first suction device 120 and a first dust-collecting device 130 installed in the robot body 110.

The first suction device 120 is used to generate a suction force required to suction dust. The first suction device 120 includes a suction motor (not shown) and a blowing fan (not shown). The first dust-collecting device 130 is used to collect and store the dust introduced into the robot body 100 by the suction force. The first dust-collecting device 130 may incorporate a filter 131 to prevent the dust from being introduced into the first suction device 120, and a dust-amount sensor 132 to sense the amount of the dust accumulated in the dust-collecting device 130.

The robot body 110 is provided, at the bottom thereof, with a pair of drive wheels 111, for the self-running of the robot cleaner 100. The pair of drive wheels 111 can be selectively driven by a drive motor (not shown) provided to rotate the drive wheels 111, respectively, to move the robot cleaner 100 in a desired direction. An obstacle detecting sensor 112, such as an infrared sensor, ultrasonic sensor, or the like, is installed at an outer surface of the robot body 110. The obstacle detecting sensor 112 is used to measure a distance from the robot cleaner 100 to an obstacle located around the robot cleaner 100, to assist the robot cleaner 100 to avoid the obstacle.

The robot body 110 has an inlet hole 113 formed in the bottom thereof to suction dust from the floor of the cleaning region, and a vent hole 114 formed in the top thereof to discharge air, discharged from the first suction device 120, to the outside of the robot body 110. Also, the robot body 110 has a dust discharge port 115 formed in the top thereof to discharge the dust, collected in the first dust-collecting device 130, into the docking station 200 when the robot cleaner 100 docks with the docking station 200.

A brush 116 to sweep up the dust on the floor is rotatably installed to the robot body 110 at a position adjacent to the inlet hole 113. Also, an inlet pipe 117 is installed between the inlet hole 113 and the first dust-collecting device 130 to connect them with each other.

The dust discharge port 115 is provided with an opening/closing device 140. The opening/closing device 140 closes the dust discharge port 115 during the cleaning operation of the robot cleaner 100, to prevent the suction force of the first suction device 120 from leaking through the dust discharge port 115. Also, when it is desired to remove the dust collected in the first dust-collecting device 130 after the robot cleaner 100 docks with the docking station 200, the opening/closing device 140 opens the dust discharge port 115, to allow the dust in the first dust-collecting device 130 to move into the docking station 200.

The opening/closing device 140 includes an opening/closing member 141 having one end hingedly coupled to the robot body 110 so as to open or close the dust discharge port 115, and a spring (not shown) to elastically bias the opening/closing member 141 in a direction closing the dust discharge port 115.

Meanwhile, the robot cleaner 100 includes a charging battery 150 to supply power required for the operation thereof. The charging battery 150 is connected to a charging terminal 151 of the robot body 110. The charging terminal 151 protrudes outward from the robot body 110 and can be charged by a commercial alternating current source when the robot cleaner 100 docks with the docking station 200.

As shown in FIG. 2, the docking station 200 includes a station body 210, a second suction device 220 installed in the station body 210 to generate a suction force, and a second dust-collecting device 230 to collect the dust suctioned from the first dust-collecting device 130 of the robot cleaner 100 by operation of the second suction device 220. Although not shown in the drawings, the second suction device 200 includes a suction motor (not shown) and a blowing fan (not shown) to be rotated by the suction motor.

The station body 210 has an extending portion 210*a* extending forward to cover the top of the robot cleaner 100 when the robot cleaner 100 docks with the docking station 200. The extending portion 210*a* incorporates a suction channel 211 to guide the dust suctioned through a dust suction port 331 into the second dust-collecting device 230. A receiving region 210*b* is defined below the extending portion 210*a* to receive the robot cleaner 100 when the robot cleaner 100 docks with the docking station 200.

The robot cleaner system according to the present invention further includes a docking device 300 to displace the dust suction port 331 of the docking station 200, so as to allow the dust suction port 331 to come into close contact with the dust discharge port 115 of the robot cleaner 100 when the robot cleaner 100 docks with the docking station 200. The docking device 300 is operated by a movement of the robot cleaner 100 without a separate drive device. Hereinafter, the configuration of the docking device 300 will be described with reference to FIGS. 1 to 3.

Figure 3:
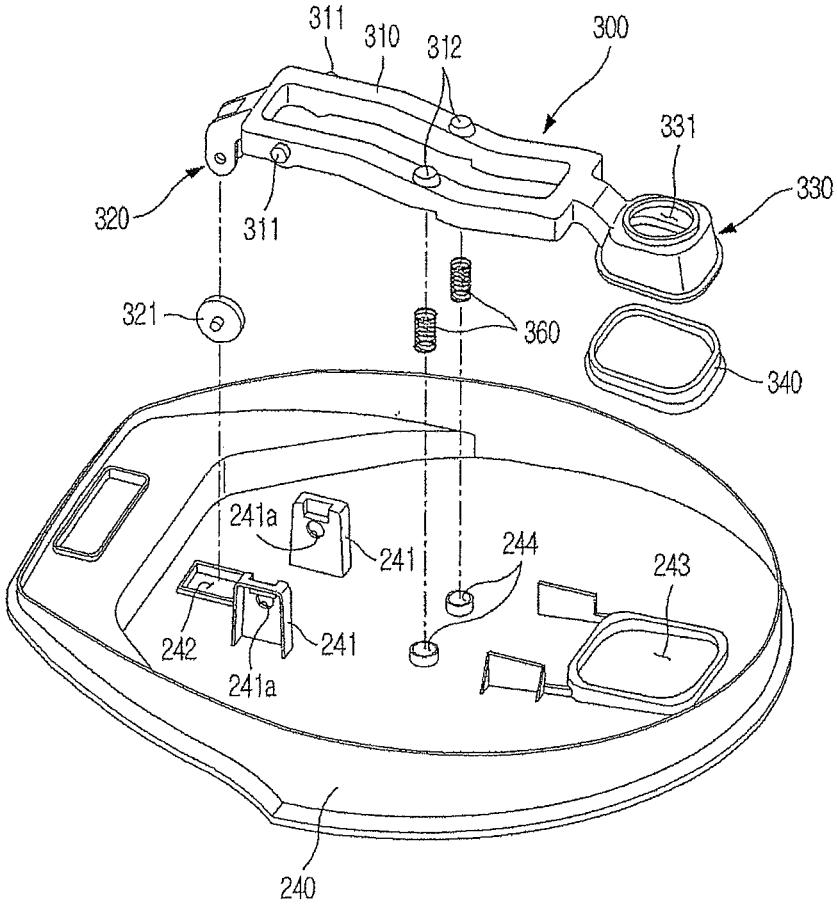
FIG. 3 is a perspective view showing the configuration of a docking device of the robot cleaner system according to the present invention.

FIG. 3 is a perspective view showing the configuration of the docking device of the robot cleaner system according to the present invention. As shown in FIGS. 1 to 3, the docking device 300 includes a link member 310 coupled to the docking station 200 in a pivotally rotatable manner.

One end of the link member 310 is provided with a contact portion 320 to come into contact with the robot cleaner 100 when the robot cleaner 100 docks with the docking station 200. The other end of the link member 310 is provided with a docking portion 330. The dust suction port 331 is defined in the docking portion 330. If the contact portion 320 of the link member 310 comes into contact with the robot cleaner 100 that is moving to the docking station 200, the link member 310 performs a seesaw motion, thereby allowing the dust suction port 331 to come into close contact with the dust discharge port 115 of the robot cleaner 100.

The link member 310 has a rotating shaft 311 as a rotating center thereof. The rotating shaft 311 is coupled to a frame 240 defining the bottom of the extending portion 210*a* of the docking station 200. The rotating shaft 311 of the link member 310 is preferably located adjacent to the contact portion 320. This is to allow the docking portion 330 located at the opposite side of the contact portion 320 to attain a relatively large pivotal rotation angle even if the contact portion 320 has a small pivotal rotation angle. Meanwhile, the frame 240 has upwardly protruding shaft coupling portions 241 arranged by a predetermined interval. The shaft coupling portions 241 have coupling holes 241*a*, respectively, for the coupling of the rotating shaft 311 of the link member 310.

The contact portion 320 of the link member 310 extends downward through a first opening 242 perforated in the frame 240, to come into contact with an upper surface of the robot body 110 upon docking of the robot cleaner 100. The contact portion 320 may be provided with a roller 321. The roller 321 serves to guide an efficient movement of the contact portion 320 even in a state wherein the contact portion 320 of the link member 310 comes into contact with the robot cleaner 100.

Meanwhile, the robot cleaner 100 has a slope 118 to guide the movement of the contact portion 320. The slope 118 is configured to assure an upward pivotal rotation of the contact portion 320 when the robot cleaner 100, which is in contact with the contact portion 320, moves toward the docking station 200.

The frame 240 has a second opening 243 perforated at a position corresponding to the docking portion 330 of the link member 310. The dust suction port 331 defined in the docking portion 330 is exposed to the outside below the frame 240 through the second opening 243.

The docking device 300 may also include a sealing member 340 to seal a gap between the dust discharge port 115 of the robot cleaner 100 and the dust suction port 331 of the docking station 200. The sealing member 340 may be fitted around the docking portion 330 to surround the dust suction port 331. Specifically, even in a state wherein the dust suction port 331 and the dust discharge port 115 come into close contact with each other by the docking device 300, there may still exist a gap between the dust suction port 331 and the dust suction port 115. The sealing member 340 prevents the loss of a suction force through the gap.

A flexible joint pipe having repeatedly formed pleats (See reference numeral 350 in FIG. 2) is installed between the docking portion 330 and the suction channel 211 of the docking station 200. One end of the joint pipe 350 communicates with the dust suction port 331, and the other end of the joint pipe 350 communicates with the suction channel 211. The joint pipe 350 is flexibly folded or unfolded according to a movement of the docking portion 330 when the docking portion 330 is pivotally rotated vertically.

The docking device 300 further includes elastic members 360 to elastically bias the link member 310 such that the dust suction port 331 of the docking portion 330 is spaced apart from the dust discharge port 115 of the robot cleaner 100. The elastic members 360 are located between the rotating shaft 311 of the link member 310 and the docking portion 330, to elastically support the link member 310. The link member 310 has fixing recesses 312 each fixing one side of the associated elastic member 360. The frame 240 has fixing recesses 244 each fixing the other side of the associated elastic member 360. Thereby, each elastic member 360 is mounted between the two fixing recesses 312 and 244.

Meanwhile, as shown in FIG. 2, the station body 210 incorporates a charging device 250 to charge the charging battery 150 of the robot cleaner 100. The charging device 250 is provided at one side thereof with a power terminal 251, which will be electrically connected with the charging terminal 151 upon docking of the robot cleaner 100.

Figure 4:
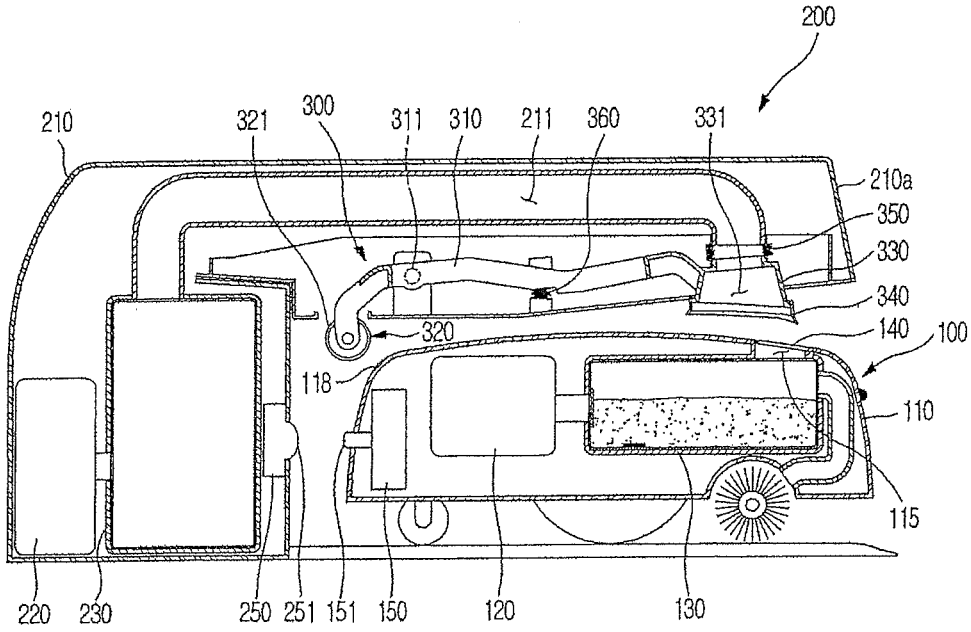
FIGS. 4 and 5 are sectional views illustrating the operation of the robot cleaner system according to the first embodiment of the present invention.
Figure 5:
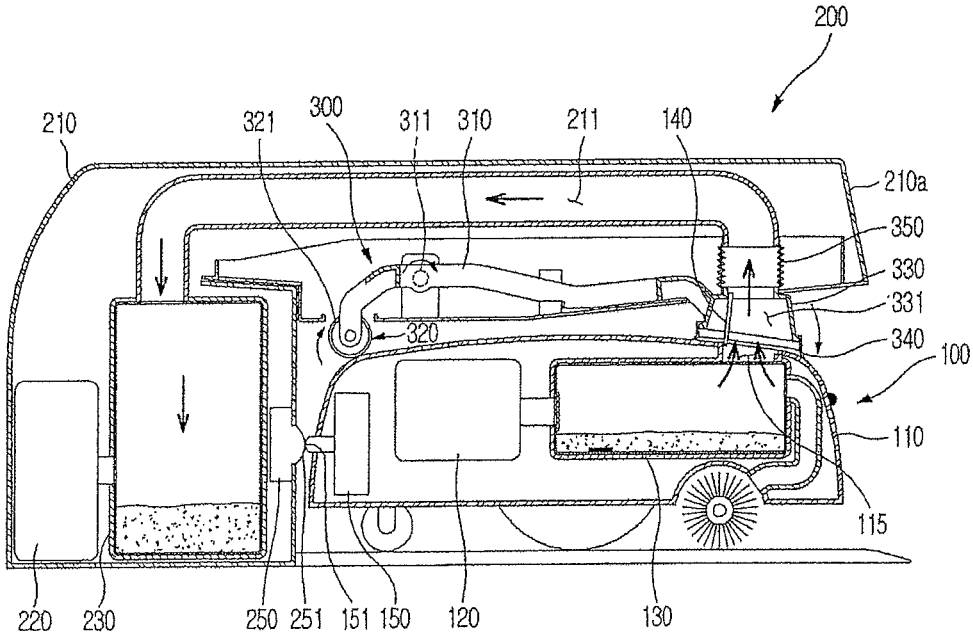

Hereinafter, the operation of the robot cleaner system having the above described configuration will be described with reference to FIGS. 1 to 5. FIGS. 4 and 5 are sectional views illustrating the operation of the robot cleaner system according to the first embodiment of the present invention.

If a cleaning operation begins, the robot cleaner 100 cleans the floor by self-running thereof. In this case, the dust discharge port 115 of the robot cleaner 100 is closed by the opening/closing device 140, to prevent the suction force generated by the first suction device 120 from leaking through the dust discharge port 115. With the suction force, dust on the floor is suctioned through the inlet hole 113 and the inlet pipe 117, thereby being collected in the first dust-collecting device 130.

If the dust over a predetermined level is accumulated in the first dust-collecting device 130, the robot cleaner 100 stops the cleaning operation and returns to the receiving region 210*b* of the docking station 200 for the discharge of the dust. When the robot cleaner 100 moves below the extending portion 210*a* as shown in FIG. 4, the docking portion 330 of the link member 310 keeps a predetermined distance with the robot cleaner 100 under the influence of an elastic force generated by the elastic members 360. Accordingly, there is no interference between the docking portion 330 and the robot cleaner 100.

As shown in FIG. 5, if the robot cleaner 100 further moves to come into contact with the contact portion 320 of the link member 310, the contact portion 320 is guided by the slope 118 of the robot body 110, so as to be pivotally rotated upward by a predetermined angle. Thereby, the docking portion 330, located at the opposite side of the contact portion 320 about the rotating shaft 311, is pivotally rotated downward, thereby causing the dust suction port 331 of the docking portion 330 to come into close contact with the dust discharge port 115 of the robot cleaner 100.

After a docking operation is completed as described above, the second suction device 220 of the docking station 200 begins to operate. With a suction force generated by the second suction device 200, the opening/closing device 140 of the robot cleaner 100 is opened, and the dust collected in the first dust-collecting device 130 is suctioned into the second dust-collecting device 230 by sequentially passing through the dust discharge port 115, the dust suction port 331, the joint pipe 350, and the suction channel 211.

Meanwhile, the charging terminal 151 of the robot cleaner 100 is connected to the power terminal 251 of the docking station 200, to charge the charging battery 150 of the robot cleaner 100.

If the dust in the first dust-collecting device 130 is completely removed, the operation of the second suction device 200 is stopped, and the robot cleaner 100 undocks with the docking station 200, to again perform a cleaning operation. If the contact portion 320 of the link member 310 is separated from the robot body 110 by a movement of the robot cleaner 100, the contact portion 320 is pivotally rotated downward by the elastic force of the elastic members 360, and the docking portion 330 is pivotally rotated upward. Thereby, the dust suction port 331 of the docking portion 330 is spaced apart from the dust discharge port 115 of the robot cleaner 100 by a predetermined distance, and the robot cleaner 100 can move to a cleaning region.

Figure 6:
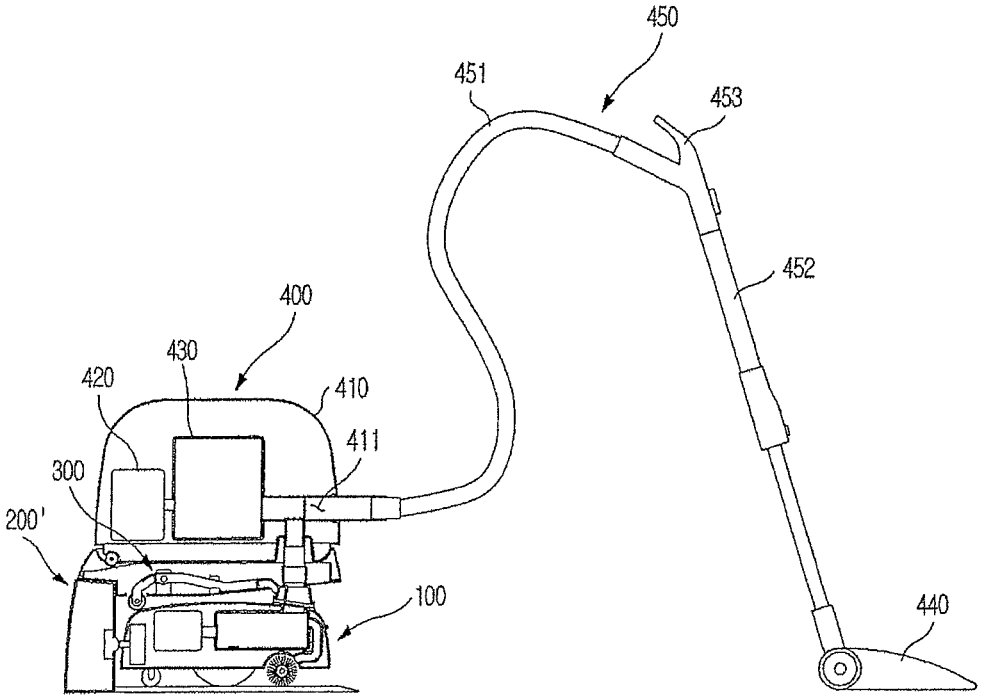
FIG. 6 is a sectional view illustrating the configuration of a robot cleaner system according to a second embodiment of the present invention.
Figure 7:
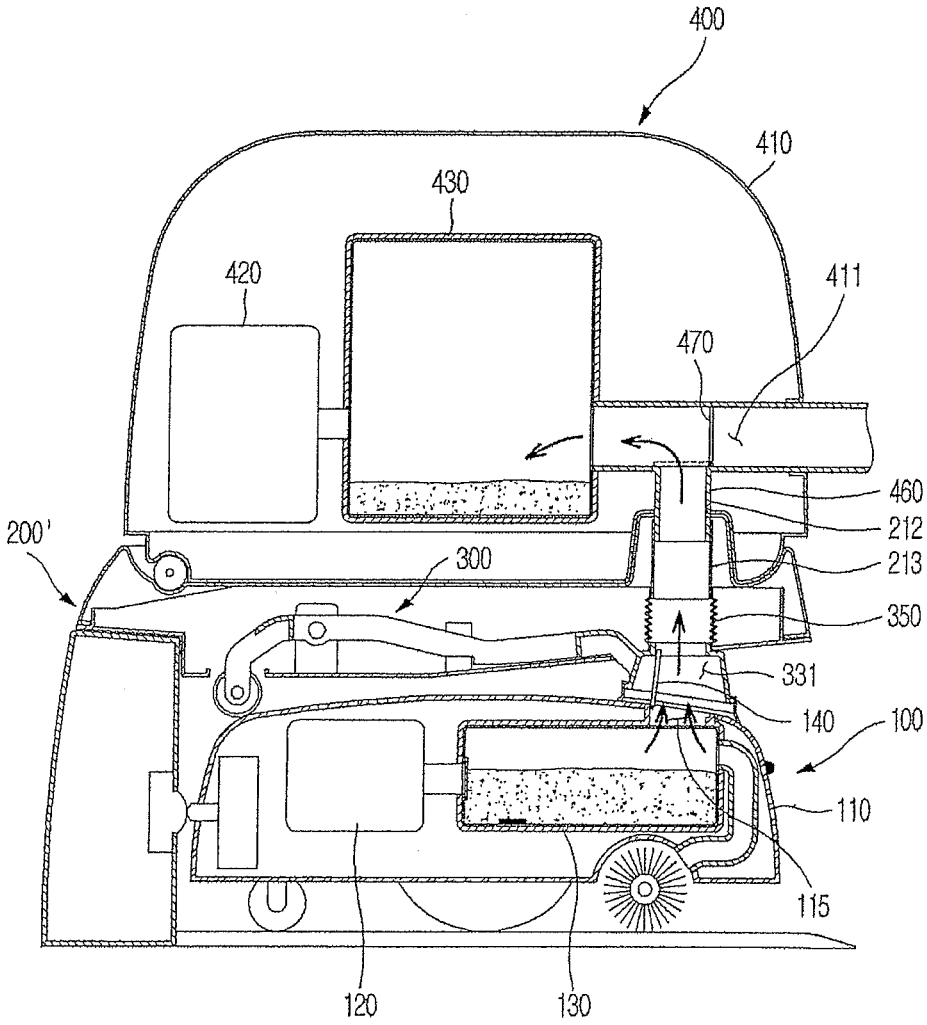
FIG. 7 is a sectional view showing a partial configuration of FIG. 6.

FIG. 6 is a sectional view illustrating the configuration of a robot cleaner system according to a second embodiment of the present invention. FIG. 7 is a sectional view showing a partial configuration of FIG. 6. In the present embodiment, a vacuum cleaner is connected to the docking station, to suction dust in the robot cleaner. In the following description, the same reference numerals will be used to refer to the same elements as those of the embodiment shown in FIGS. 1 to 5, and only characteristic items of the present embodiment will be described.

As shown in FIGS. 6 and 7, the robot cleaner system according to the present embodiment includes a vacuum cleaner 400 to be connected to a docking station 200'. The vacuum cleaner 400 is used to suction dust collected in the robot cleaner 100 when the robot cleaner 100 docks with the docking station 200'.

The vacuum cleaner 400 is separable from the docking station 200'. Accordingly, a user can clean the floor by using the separated vacuum cleaner 400 as a general vacuum cleaner. That is, once being separated from the docking station 200', the user can clean the floor while carrying the vacuum cleaner 400. Hereinafter, the vacuum cleaner 400 will be referred to as a manual vacuum cleaner for distinction with the robot cleaner 100.

The manual vacuum cleaner 400 generally includes a suction device 420 and a dust-collecting device 430. When the manual vacuum cleaner 400 is connected to the docking station 200' in order to suction the dust collected in the robot cleaner 100, the docking station 200' has no need for a suction device or dust-collecting device, and the overall configuration of the docking station 200' can be simplified.

The manual vacuum cleaner 400 includes a suctioning mouth unit 440 to suction dust or dirt on the floor, and a suction pipe 450 to connect the suction mouth unit 400 and the vacuum cleaner body 410 with each other so as to transmit a suction force generated from the suction device 420 to the suctioning mouth unit 440.

The suction pipe 450 includes a first suction pipe 451 and a second suction pipe 452. A handle member 453, provided with a variety of operating buttons, is located between the first suction pipe 451 and the second suction pipe 452. The first suction pipe 451 is a flexible pleated pipe. The first suction pipe 451 has one end connected to a vacuum cleaner body 410, and the other end connected to the handle member 453. The second suction pipe 452 has one end connected to the suctioning mouth unit 440 and the other end connected to the handle member 453. The vacuum cleaner body 410 incorporates a suction channel 411 to connect the first suction pipe 451 and the dust-collecting device 430 with each other.

The manual vacuum cleaner 400 can be seated on the top of the docking station 200' when being connected with the docking station 200'.

The docking station 200' has a connecting port 212 perforated in the top thereof for the connection of the manual vacuum cleaner 400. The connecting port 212 communicates with the dust suction port 331 of the docking station 200' through the joint pipe 351 and a docking pipe 213. The manual vacuum cleaner 400 includes a connecting pipe 460 to be fitted into the connecting port 212 of the docking station 200' when the manual vacuum cleaner 400 is seated on the docking station 200'. One end of the connecting pipe 460 communicates with the suction channel 411 of the manual vacuum cleaner 400.

A path converter 470 is provided at a junction position of the connecting pipe 460 and the suction channel 411, to selectively open or close the connecting pipe 460 and the suction channel 411. While the user cleans the floor by use of the manual vacuum cleaner 400, the path converter 470 closes the connecting pipe 460 and opens the suction channel 411, to apply the suction force of the suction device 420 to the suctioning mouth unit 440. Also, when the manual vacuum cleaner 400 is used to suction the dust collected in the robot cleaner 100, the path converter 470 closes the suction channel 411 to communicate the connecting pipe 460 with a part of the suction channel 411. Thereby, the suction force of the suction device 420 is applied to the first dust-collecting device 130 of the robot cleaner 100 through the dust suction port 331 and the dust discharge port 115.

When it is desired to clean the floor by use of the manual vacuum cleaner 400, the user can separate the manual vacuum cleaner 400 from the docking station 200', to use the manual vacuum cleaner 400 as a general vacuum cleaner.

On the other hand, when it is desired to clean the floor by use of the robot cleaner 100, the manual vacuum cleaner 400 is seated on the docking station 200'. In this seating state, the connecting pipe 460 of the manual vacuum cleaner 400 is coupled with the docking pipe 213 of the docking station 200'. With this configuration, if the robot cleaner 100 returns to the docking station 200' for the discharge of the dust, as described above with reference to FIGS. 4 and 5, the dust suction port 331 of the docking station 200' comes into close contact with the dust discharge port 115 of the robot cleaner 100 by the docking device 300.

Once the docking of the robot cleaner 100 is completed, the suction device 420 of the manual vacuum cleaner 400 begins to operate. Thereby, the opening/closing device 140 of the robot cleaner 100 is opened by the suction force of the suction device 420, and the dust collected in the first dust-collecting device 130 of the robot cleaner 100 can be suctioned into the dust-collecting device 430 by passing through the dust discharge port 115, the dust suction port 331, the joint pipe 350, the docking pipe 213, the connecting pipe 460, and the suction channel 411 sequentially.

Meanwhile, although the above embodiments describe the docking device 300 installed to the docking station 200 or 200', it may be considered that the docking device 300 can be installed to the robot cleaner 100 by a simple design change. In this case, when the robot cleaner docks with the docking station, the contact portion of the link member will be pivotally rotated as it comes into contact with the docking station. Also, the docking portion of the link member will define the dust discharge port of the robot cleaner such that the dust discharge port comes into close contact with the dust suction port of the docking station.

As apparent from the above description, according to the present invention, dust collected in a robot cleaner can be transferred into a docking station in a state wherein a dust discharge port of the robot cleaner comes into close contact with a dust suction port of the docking station. As a result, the present invention has the effect of preventing the loss of a suction force or the leakage of the dust between the dust suction port and the dust discharge port.

Further, according to the present invention, the close contact between the dust discharge port and the dust suction port can be accomplished by operation of a docking device without an additional drive device. Accordingly, the present invention has the effect of preventing the configuration of the resulting system from being complicated due to the additional drive device, and consequently, reducing the costs of parts.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A robot cleaner system comprising:

a robot cleaner having a dust discharge port; and a docking station having a dust suction port to suction dust collected in the robot cleaner and a connecting port communicating with the dust suction port, wherein, during a dust removal operation, the dust collected in the robot cleaner is removed therefrom by coupling the dust discharge port of the robot cleaner to the dust suction port of the docket station and applying a suction force via the connecting port of the docket station, the suction force is generated by a suction device external to the docking station and the robot cleaner, wherein the docking station includes a support platform adapted to support the suction device such that the suction device is positioned above the robot cleaner during the dust removal.

2. The system according to claim 1, wherein the docking device comprises a manual vacuum cleaner having a connecting pipe which can be fitted into the connecting port of the docking device.

3. The system according to claim 1, wherein the docking device comprises a link member rotatably mounted to the docking station, and the link member comprises one end having a contact portion to come into contact with an upper surface the robot cleaner, and the other end having a docking portion defining the dust suction port therein.

4. The system according to claim 3, wherein the link member performs a seesaw movement in a first direction when the robot cleaner moves while contacting with the contact portion, so as to allow the dust suction port to come into close contact with the dust discharge port, and also performs a seesaw movement in a second direction when the robot cleaner is separated from the contact portion, so as to space apart the dust suction port from the dust discharge port.

* * * * *

UNITED STATES PATENT AND TRADEMARK OFFICE

CERTIFICATE OF CORRECTION

PATENT NO. : 8,635,739 B2
APPLICATION NO. : 13/247430
DATED : January 28, 2014
INVENTOR(S) : Youn Baek Lee et al.

It is certified that error appears in the above-identified patent and that said Letters Patent is hereby corrected as shown below:

In the Claims

Column 10, Line 42, In Claim 3, after "surface" insert -- of --, therefor.

Signed and Sealed this
Thirteenth Day of January, 2015

Michelle K. Lee

Michelle K. Lee
*Deputy Director of the United States Patent and Trademark Office*